US008419447B2

(12) United States Patent
Freedman

(10) Patent No.: US 8,419,447 B2
(45) Date of Patent: Apr. 16, 2013

(54) SURFACE-MOUNT TECHNOLOGY (SMT) DEVICE CONNECTOR

(75) Inventor: Gary Marc Freedman, Stow, MA (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 197 days.

(21) Appl. No.: 13/375,308

(22) PCT Filed: Aug. 31, 2009

(86) PCT No.: PCT/US2009/055549

§ 371 (c)(1),
(2), (4) Date: Nov. 30, 2011

(87) PCT Pub. No.: WO2011/025507

PCT Pub. Date: Mar. 3, 2011

(65) Prior Publication Data

US 2012/0088409 A1 Apr. 12, 2012

(51) Int. Cl.
*H01R 12/00* (2006.01)

(52) U.S. Cl.
USPC ..... 439/83; 439/876; 439/247

(58) Field of Classification Search ..... 439/83, 439/876, 247, 248
See application file for complete search history.

(56) References Cited

U.S. PATENT DOCUMENTS 4,422,128 A * 12/1983 Zurlinden et al. ..... 361/776
4,655,517 A * 4/1987 Bryce ..... 439/83
4,836,792 A * 6/1989 Glover ..... 439/81
4,936,786 A * 6/1990 Klein et al. ..... 439/76.1
5,102,356 A * 4/1992 Adams et al. ..... 439/751
5,586,008 A * 12/1996 Kozel et al. ..... 361/743
5,731,958 A * 3/1998 Kozel ..... 361/743
6,913,468 B2 7/2005 Dozier, II et al.
7,488,192 B1 * 2/2009 Eagle et al. ..... 439/159
2001/0039724 A1 11/2001 Ohshima et al.
2007/0232090 A1 10/2007 Colgan et al.
2009/0215295 A1 * 8/2009 Tseng ..... 439/247

FOREIGN PATENT DOCUMENTS

EP 2034554 A1 3/2009

OTHER PUBLICATIONS

PCT; "Notification of Transmittal of the International Search Report and the Written Opinion of the International Searching Authority, or the Declaration"; PCT/US2009/055549; mailed May 31, 2010; 15 pages.

* cited by examiner

*Primary Examiner* — Gary F. Paumen

(57) ABSTRACT

A surface-mount technology (SMT) device connector (100) for connecting a removable component (150) to a substrate (160). The SMT device connector (100) includes an insulated housing (135) for receiving the removable component (150) and the insulated housing (135) is surface mounted to a SMT device connector location on the substrate (160). The SMT device connector also includes two stress relief posts (110) protruding from a mounting surface (137) of the insulated housing (135). The two stress relief posts (110) correspond to two stress relief post apertures (111) in the substrate (160) and the two stress relief posts (110) are not required to be constrained along a longitudinal axis (140) of the insulated housing (137) in the corresponding stress relief post apertures (111) to relieve stress on the SMT device connector (100) during SMT reflow.

12 Claims, 3 Drawing Sheets

SURFACE-MOUNT TECHNOLOGY (SMT) DEVICE CONNECTOR

FIELD

Embodiments of the present technology relates generally to the field of device connectors.

BACKGROUND

Conventional dual in-line memory module (DIMM) connectors typically include board locks that locate and stake the DIMM connector to a DIMM connector footprint on the printed wiring board (PWB) or substrate. The board locks are oriented perpendicular to the longitudinal axis of the DIMM connector insulator body and also hold and constrain the DIMM connector in the direction of the longitudinal axis of the DIMM connector. During soldering, any difference in the coefficient of thermal expansion (CTE) between the DIMM connector insulator and the PWB laminate can cause deleterious effects on the DIMM connector, solder joints and/or PWB. The deleterious effects are more pronounced if the DIMM connector is constrained within the PWB (e.g., constrained by the board locks). Examples of the deleterious effects are, stress on the solder joints between the DIMM connector and PWB, opens and shorts due to warpage and bow of the DIMM connector and/or PWB and the increased likelihood that solder joints will fail.

Typically, a DIMM connector is mounted to a substrate via plated-through hole (PTH) technology because of, in part, the mechanical connection strength of the DIMM connector to the PWB. However, in some instances, it may not be possible to implement PTH because of design requirements that may prohibit utilization of PTH mounting technology.

Figure 1:
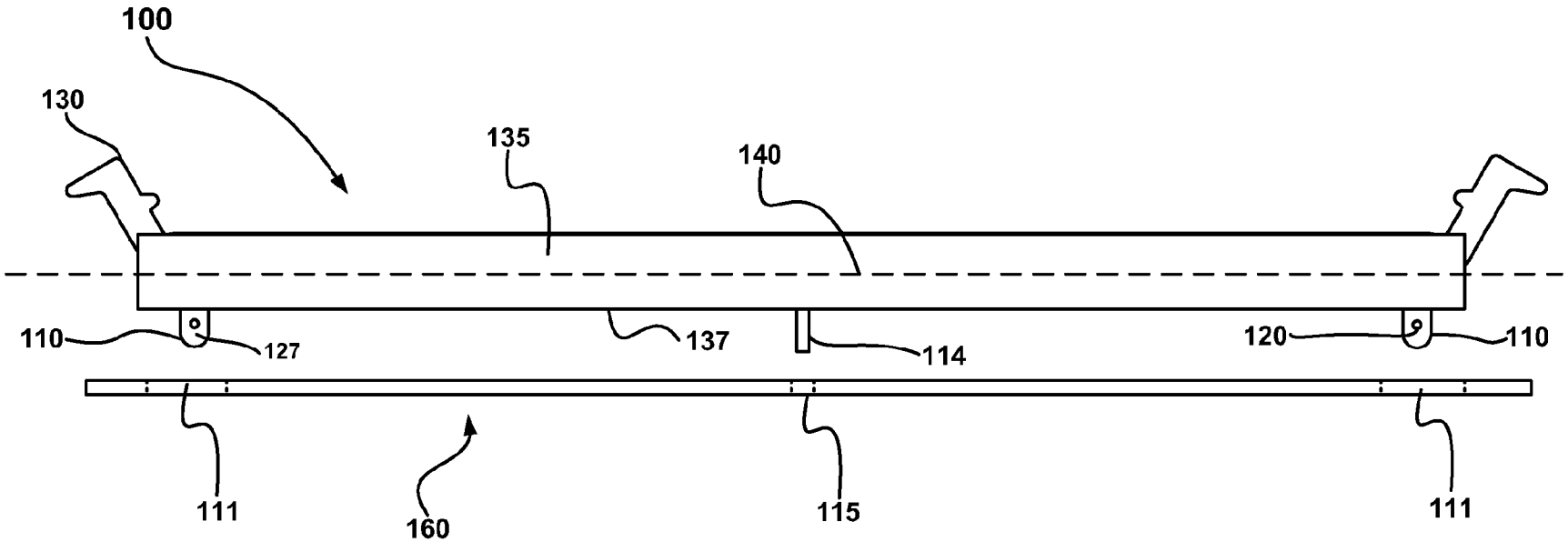
FIG. 1 illustrates an example of a SMT device connector, in accordance with an embodiment of the present invention.

The drawings referred to in this description should be understood as not being drawn to scale except if specifically noted.

DESCRIPTION OF EMBODIMENTS

Reference will now be made in detail to embodiments of the present technology, examples of which are illustrated in the accompanying drawings. While the technology will be described in conjunction with various embodiment(s), it will be understood that they are not intended to limit the present technology to these embodiments. On the contrary, the present technology is intended to cover alternatives, modifications and equivalents, which may be included within the spirit and scope of the various embodiments as defined by the appended claims.

Furthermore, in the following description of embodiments, numerous specific details are set forth in order to provide a thorough understanding of the present technology. However, the present technology may be practiced without these specific details. In other instances, well known methods, procedures, components, and circuits have not been described in detail as not to unnecessarily obscure aspects of the present embodiments.

Connecting a DIMM card in a DIMM connector can cause excessive force to the connection point between the DIMM connector and a substrate because the DIMM card can act as an extension of the connector and act as a large lever which may stress solder joints to fracture. Therefore, a DIMM connector is typically connected to a substrate by PTH because, in part, the mechanical strength of PTH solder joints is the strongest means of soldering attachment to the substrate.

In general, a PTH component will have a plurality of pins that correspond to a plurality of plated-through holes (e.g., vias) on a PWB. The PTH component is placed on the PWB with the pins seated in the corresponding through holes. The PWB with the PTH components is placed through a wave soldering process that applies solder to the bottom side of the board from which the pins of the components are protruding. The solder enters the plated-through holes via capillary action and subsequently solidifies. Thus, the components are electrically and mechanically connected to the PWB.

Accordingly, the mechanical strength of the pins of the DIMM connector inserted in the corresponding through holes in the substrate is one reason why DIMM connectors are typically mounted to a substrate via PTH as compared to a more common mounting process of surface-mount technology (SMT). However, it may be advantageous to mount a DIMM connector to a substrate via SMT rather than PTH.

In general, a SMT component has solderable leads that correspond to bonding pads on a PWB. A solder paste is stenciled onto the bonding pads of the PWB. The SMT component is then placed on the PWB and aligned with and placed into the corresponding solder paste-coated bonding pads. The PWB with the placed SMT components is typically heated in a conveyorized reflow oven or other heating device that brings the temperature of the PWB and components to a temperature above the melting point of the solder paste. After cooling of the PWB and components, the solder returns to a solid state which bonds the components electrically and mechanically to the PWB.

Figure 2:
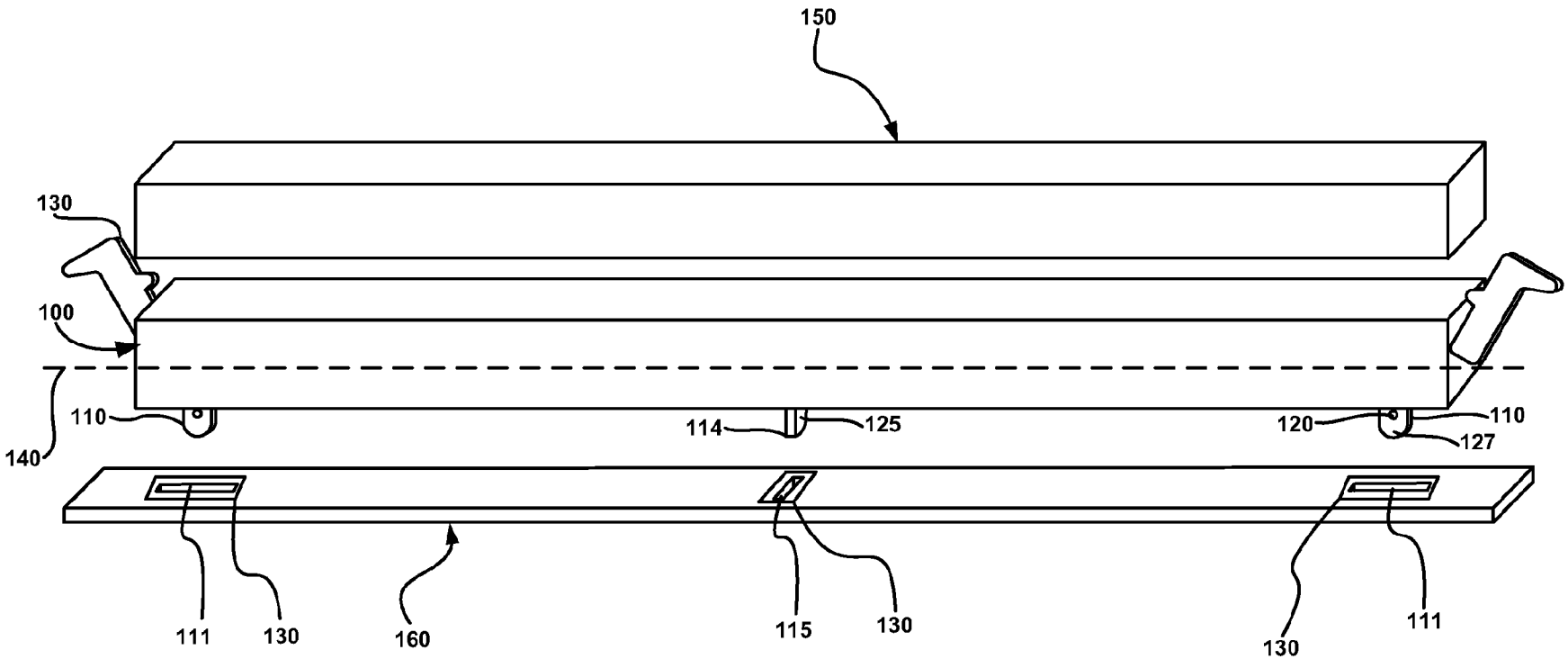
FIG. 2 illustrates an example of a SMT assembly, in accordance with an embodiment of the present invention.
Figure 3:
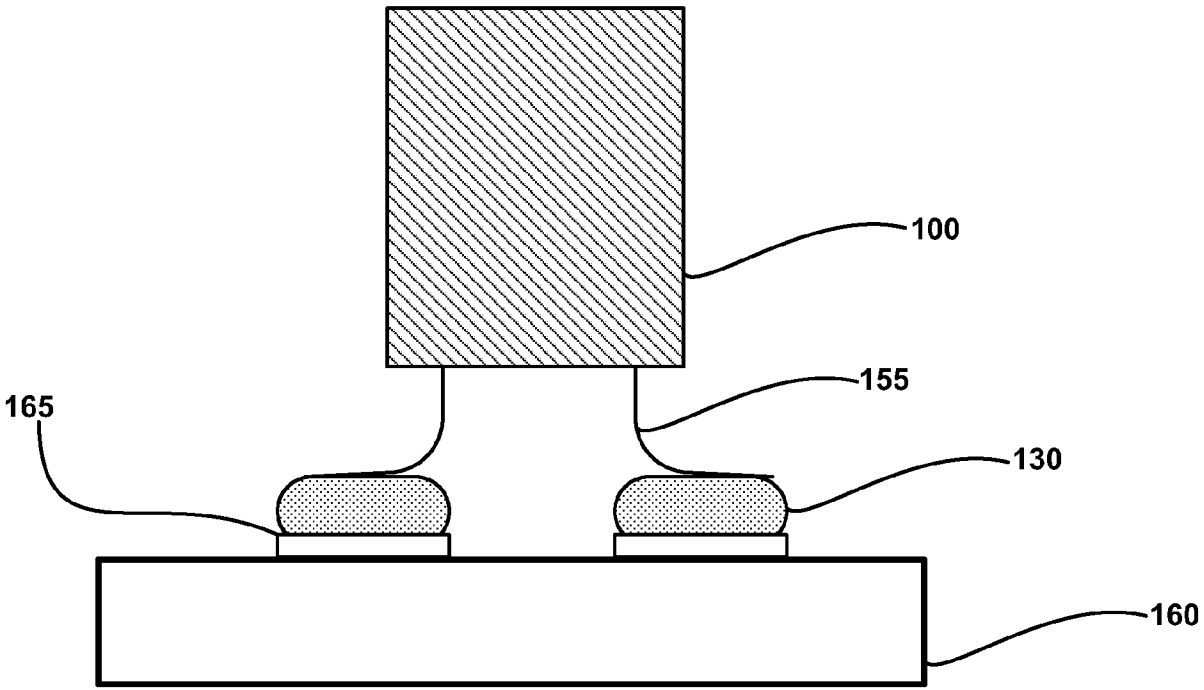
FIG. 3 illustrates an example of a SMT assembly, in accordance with an embodiment of the present invention.

FIGS. 1-3 illustrate examples of an SMT device connector and an SMT assembly. FIG. 1 illustrates a SMT device connector 100 for connecting a removable component (not shown) to a substrate 160, in accordance with an embodiment of the present invention. FIG. 1 illustrates the SMT device connector 100 aligned in relationship to the substrate 160.

FIG. 2 illustrates an exploded isometric view of an SMT assembly 200 that includes a removable component 150 (e.g., DIMM card), SMT device connector 100 (e.g., SMT DIMM connector, Peripheral Component Interconnect (PCI), Rambus in-line Memory Module (RIMM) connector) and substrate 160 (e.g., PWB). FIG. 2 illustrates the physical relationship between the removable component 150, SMT connector device 100 and the substrate 160.

FIG. 3 illustrates a side view of the SMT device connector electrically connected to the substrate 160 via solderable leads 155. The solderable leads 155 correspond with bonding pads 165 on the substrate 160. A solder paste 130 is disposed on the bonding pads 165, as described above for the SMT process.

The SMT device connector 100 includes ejectors 130, an insulated housing 135, stress relief posts 110 and locating post 114. The ejectors 130 are for ejecting the removable component from the SMT device connector. In one embodiment, the removable component is a DIMM card and the SMT device connector is a SMT DIMM connector. It should be appreciated that SMT device connector can be any SMT device connector that is capable of being soldered to the PWB electrical and mechanical interconnection.

The insulated housing 135 is for receiving the removable component such as a DIMM card. The insulated housing includes a bottom surface 137. The bottom surface includes a plurality of solderable leads 155 (shown in FIG. 3) that correspond to a plurality of bonding pads 165 (shown in FIG. 3) on the substrate 160. During SMT process, as described above, the leads are mechanically and electrically connected to the bonding pads by means of soldering.

Locating post 114 is centrally located along the longitudinal axis on the SMT device connector and is for aligning and locating the SMT device connector and the plurality of solder joints with the corresponding bonding pads 165 of the substrate 160 during the SMT process. Locating post 114 rigidly seats within a corresponding PTH 115 on the substrate 160 and is subsequently soldered to the board during the SMT process. In other words, PTH 115 is an aperture that receives locating post 114. In one embodiment, locating post 114 includes a rounded distal end to facilitate insertion of the locating post in corresponding PTH 115. In another embodiment, locating post 114 is a rectangular cross-section that protrudes from the bottom surface of the SMT device connector. The rectangular cross-section includes a front wall 125 and a side wall, where the front wall is longer than the side wall. The front wall 125 or longitudinal wall is oriented perpendicular to the longitudinal axis 140 of the SMT device connector. In one embodiment, the longitudinal axis 140 of the SMT device connector 100 is the axis extending from a distal end to the opposite distal end.

In one embodiment, locating post 114 is a metal post located in a PTH 115 (as shown in FIG. 2), PTH 115 includes solder paste 130 for facilitating in soldering the SMT device connector to the substrate 160 during the SMT process.

In another embodiment, locating post 114 is a metal board-lock that is received by either a PTH or a non-plated through hole (NPTH). In a further embodiment, locating post 114 is a non-soldered plastic post in a NPTH.

Stress relief posts 110 protrude from a mounting surface 137 of the insulated housing 135. Stress relief posts 110 correspond to stress relief post apertures 111 in the substrate 160. Stress relief posts 110 are seated within the stress relief apertures 111 and are subsequently soldered to the substrate 160 during the SMT process. In one embodiment, stress relief apertures 111 are a PTH. In another embodiment, stress relief posts 110 are non-soldered plastic posts. In a further embodiment, stress relief posts 110 are metal board-locks that are received by either PTHs or non-plated-through holes (NPTH).

Stress relief posts 110 are configured to stabilize the connector against stresses induced on the SMT device connector 100 during a SMT process as well as after the soldering process. During the SMT reflow process, the SMT device connector 100 and the substrate 160 are heated to a temperature above the melting point of the solder paste. If the CTE of the SMT device connector 100 is different than the CTE of the substrate 160 (typically there is a slight difference), then the SMT device connector does not expand proportionally to the substrate 160, which can cause stresses to be induced to both the SMT device connector and the substrate. Moreover, if the SMT device connector is rigidly affixed to the substrate during the SMT reflow process, then the SMT device connector is urged to expand due to the thermally induced dimensional changes of the substrate (and vice versa), which can lead to warpage of both the SMT device connector and the substrate. Accordingly, stresses are induced on both the SMT device connector and PWB. In particular, conventional board locks limit translation of mechanical forces through the connector which can lead to cracking of solder joints after soldering. Conventional board locks can be either NPTH or PTH. An example of a NPTH is a non-solderable plastic post or an unsoldered metal post. An example of a PTH is solderable metal post.

Additionally, the warpage of both the SMT device connector and substrate results in a gap between the SMT device connector and the substrate because the SMT device connector and the substrate are not co-planar. As a result, when a device (e.g., DIMM) is manually connected and/or removed from the SMT device connector, a force is exerted on the SMT device connector and substrate which "flattens" the warpage. The flattening of the warpage induces stress on SMT device connector, substrate and any surrounding components. Moreover, a moment is also exerted on the SMT device connector and substrate, which also induces additional stress on surrounding components.

The stress relief apertures 111 allow the stress relief posts 110 to slide freely in the direction of the longitudinal axis 140 of the SMT device connector 100, because the length of the stress relief apertures 111 are longer than the length of the stress relief posts 110, in the direction of the longitudinal axis of the SMT device connector until the molten solder has solidified. In other words, the stress relief posts are not required to restrain the SMT device connector in the longitudinal direction of SMT device connector. However, the stress relief apertures 111 do constrain the stress relief posts 110 in the direction orthogonal to the longitudinal axis 140 of the SMT device connector 100 to facilitate in locating the SMT device connector with the SMT device connector footprint on the substrate 100. It should be appreciated that the stress relief apertures 111 include solder paste 130 for facilitating in mounting the SMT device connector to the substrate 160.

In one embodiment, collectively, locating post 114 and stress relief posts 110 serve the same functions, which include but are not limited to (1) stabilizing the connector during the soldering process and (2) adding support to the connector post-soldering to help resist levering effects which may damage solder joints during card insertion/extraction.

Stress relief posts 110 provides for sufficient soldered slot fill because of the volume displacement. In other words, the volume of the stress relief posts 110 provides for sufficient solder displacement within the stress relief apertures 111.

As the SMT device connector and substrate both expand due to the heating of the SMT reflow process, the stress relief apertures 111 allow the SMT device connector 100 to expand and increases chances of remaining co-planar with the substrate 160 even if they have different CTEs. In particular, as the SMT device connector 100 expands, the stress relief posts 110 freely slide within the SMT stress relief apertures 111. As a result, the SMT device connector remains flatter on the substrate during the reflow process because the SMT device connector is able to relax during the heating and cooling of the SMT reflow. Accordingly, less stress is induced on the solder joints which results in improved solder joint reliability (e.g., fewer open and shorts).

It should be appreciated that there typically is always some CTE mismatch and therefore always some degree of warp or bow. However, the stress relief posts 110 located in the stress relief apertures 111 minimizes the warp or bow by not constraining the connector in the wrong way during the reflow process. Also, the orientation of the stress relief posts 110 located in the stress relief apertures 111 allows for some expansion without pinning it against the boundaries of the PTH.

In one embodiment, stress relief posts 110 include a rounded distal end to facilitate inserting the posts in corresponding stress relief posts apertures whether by machine placement or hand placement. For example, the rounded (e.g., spade-like) shape helps prevent catching a corner during insertion. In another embodiment, stress relief posts 110 are a rectangular cross-section that protrude from the mounting surface 137 of the SMT device connector 100. The rectangular cross-section includes a front wall 127 and a side wall, where the front wall is longer than the side wall. The front wall 127 or longitudinal wall is oriented parallel to the longitudinal axis 140 of the SMT device connector 100.

Stress relief posts 110 include a through-hole 120. Through-hole 120 protrudes orthogonal to the front wall 127. Through-holes 120 are configured to enhance the solder joint strength between the SMT device connector and the substrate.

In one embodiment, the stress relief posts 110 have a length (the distance from the mounting surface 137 to the distal end of the posts 110) of about one-half the thickness of the substrate 160. In another embodiment, the stress relief posts 110 length allows for effective use of Buried Intrusive Reflow (BIR) technique. In general, BIR involves soldering of plated through-hole parts into a plated-through hole on a substrate during a SMT process with a pin purposely shorter, approximately half the thickness of the PWB to facilitate good circumferential and longitudinal solder coalescence around the pin. BR relies upon solder paste deposited on the top side of the substrate (e.g., PWB) and into the PTH during the surface mount paste stenciling process to provide the solder and soldering flux requisite for solder joint formation for both SMT leads and PTH pins. During the oven reflow process, solder is melted and wets along the surfaces of the solder-tail and along the wall of the plated through-hole barrel (e.g., slots 111) of the substrate. Surface tensions and capillary action distribute the solder around and along the pin (e.g., posts 110).

Various embodiments of the present invention are thus described. While the present invention has been described in particular embodiments, it should be appreciated that the present invention should not be construed as limited by such embodiments, but rather construed according to the following claims.

The invention claimed is:

1. A surface-mount technology (SMT) device connector for connecting a removable component to a substrate, said device connector comprising:

an insulated housing for receiving said removable component, wherein said insulated housing is surface mounted to a SMT device connector location on said substrate; and two stress relief posts protruding from a mounting surface of said insulated housing, said two stress relief posts correspond to two stress relief post apertures in said substrate and said two stress relief posts are not required to be constrained along a longitudinal axis of said insulated housing in said corresponding stress relief post apertures to relieve stress on said SMT device connector during SMT reflow;

a locating post protruding centrally from said insulated housing mounting surface for locating said SMT device connector to said corresponding SMT device connector location and said locating post rigidly seated in said substrate.

2. The SMT device connector of claim 1, wherein said SMT device connector comprises:

a SMT dual in-line memory module (DIMM) connector.

3. The SMT device connector of claim 1, wherein said locating post comprises:

a longitudinal surface perpendicular to said insulated housing longitudinal direction.

4. The SMT device connector of claim 1, wherein said two stress relief posts each comprise:

a longitudinal surface parallel to said insulated housing longitudinal direction.

5. The SMT device connector of claim 1, wherein said two stress relief posts each comprise:

a through-hole orthogonal to said stress relief post longitudinal surface.

6. A surface-mount technology (SMT) assembly comprising:

a SMT device connector;

a substrate, wherein said SMT device connector is surface mounted to said substrate;

two stress relief posts protruding from a mounting surface of said SMT device connector, said two stress relief posts correspond to two stress relief post apertures in said substrate and said two stress relief posts are not required to be constrained along a longitudinal axis of said SMT device connector in said corresponding stress relief post apertures to relieve stress on said SMT device connector during SMT reflow;

a locating post protruding from said SMT device connector mounting surface, said locating post rigidly seated in a corresponding locating post aperture in said substrate.

7. The SMT assembly of claim 6, wherein said SMT device connector comprises:

a SMT dual in-line memory module (DIMM) connector.

8. The SMT assembly of claim 6, comprising:

a DIMM connected to said SMT device connector.

9. The SMT assembly of claim 6, wherein said locating post protrudes from a center of said SMT device connector mounting surface.

10. The SMT assembly of claim 6, wherein said two stress relief posts protrude from opposite distal ends of said SMT device connector mounting surface.

11. The SMT assembly of claim 6, wherein said locating post comprises:

a longitudinal surface perpendicular to said SMT device connector longitudinal direction.

12. The SMT assembly of claim 6, wherein said two stress relief posts each comprise:

a longitudinal surface parallel to said SMT device connector longitudinal axis.

* * * * *